US009279240B2

(12) United States Patent
Presnell

(10) Patent No.: US 9,279,240 B2
(45) Date of Patent: Mar. 8, 2016

(54) SINK EXTENDER SYSTEM

(75) Inventor: Donald C. Presnell, Stephens City, VA (US)

(73) Assignee: Rubbermaid Commercial Products, LLC, Winchester, VA (US)

( * ) Notice: Subject to any disclaimer, the term of this patent is extended or adjusted under 35 U.S.C. 154(b) by 895 days.

(21) Appl. No.: 13/295,636

(22) Filed: Nov. 14, 2011

(65) Prior Publication Data

US 2012/0117725 A1 May 17, 2012

Related U.S. Application Data

(60) Provisional application No. 61/414,208, filed on Nov. 16, 2010.

(51) Int. Cl.
*A47K 1/05* (2006.01)
*E03C 1/186* (2006.01)
*A47L 13/51* (2006.01)

(52) U.S. Cl.
CPC . *E03C 1/186* (2013.01); *A47K 1/05* (2013.01); *A47L 13/51* (2013.01)

(58) Field of Classification Search
CPC ..... E03C 1/32
USPC ..... 4/619–660, 695, 679, 189, 286, 4/290–292; 210/91, 236, 154, 162, 470, 210/251
See application file for complete search history.

(56) References Cited

U.S. PATENT DOCUMENTS

| | | | | |
|---|---|---|---|---|
| 1,831,966 | A * | 11/1931 | Mason | 4/652 |
| 2,623,642 | A * | 12/1952 | Looney | 211/65 |
| 3,045,252 | A * | 7/1962 | Sorrells | 4/626 |
| 3,076,202 | A * | 2/1963 | Sorrells | 4/638 |
| 4,826,539 | A * | 5/1989 | Harpold | 134/10 |
| 5,678,255 | A * | 10/1997 | Stoudamire, Sr. | 4/516 |
| 5,938,261 | A * | 8/1999 | Faba | 296/22 |
| 5,954,070 | A * | 9/1999 | Abad et al. | 134/89 |
| 6,161,228 | A * | 12/2000 | Wietecha | 4/625 |
| 6,244,311 | B1 * | 6/2001 | Hand et al. | 141/375 |
| 6,431,217 | B2 * | 8/2002 | Robinson | 138/110 |
| 6,850,208 | B1 * | 2/2005 | Ferrante | 345/1.1 |
| 6,962,381 | B2 * | 11/2005 | Warning | 296/1.07 |
| 7,152,748 | B2 * | 12/2006 | Vosbikian | 211/87.01 |
| 7,481,473 | B1 * | 1/2009 | Warning | 296/1.07 |
| 8,079,104 | B2 * | 12/2011 | Presnell et al. | 5/655 |
| 2005/0055766 | A1 * | 3/2005 | Warning | 4/619 |
| 2005/0132979 | A1 * | 6/2005 | Powers | 119/753 |
| 2005/0199267 | A1 * | 9/2005 | Oakes | 134/10 |
| 2006/0064809 | A1 * | 3/2006 | Isgro | 4/288 |
| 2012/0096647 | A1 * | 4/2012 | Presnell et al. | 5/655 |

OTHER PUBLICATIONS http://www.plumbinglogics.com/plumbing-supplies/mop-sink-baskets/, 1 page.

(Continued)

*Primary Examiner* — Lori Baker
(74) *Attorney, Agent, or Firm* — Sutherland Asbill & Brennan LLP

(57) ABSTRACT

A sink extender has a sink comprising a removable drain pan that may be connected to a conduit. An attachment mechanism connects the sink to a support. At least one tool holder supports an elongated handle of a janitorial tool over the sink. A method of using a sink extender comprises mounting the sink extender comprising a sink that drains into a flexible hose and at least one tool holder to a support surface; running the hose to a traditional sink such that water may drain from the sink to the traditional sink by gravity; securing a wet tool to the at least one tool holder such that the tool drains into the sink.

21 Claims, 7 Drawing Sheets

(56) References Cited

OTHER PUBLICATIONS http:/www.kitchensource.com/kitchen-sinks/sks-ks1102.htm, 1 page.

http//stores.nextag.com/store/4798073/product/916756720/Adjustable-Over-the-Sink, 1 page.

http://www.mustee.com/product-lines/mop-service-basins/mop-service-basins-accessories.html, 3 pages.

* cited by examiner

SINK EXTENDER SYSTEM

This application claims benefit of priority under 35 U.S.C. §119(e) to the filing date of to U.S. Provisional Application No. 61/414,208, as filed on Nov. 16, 2010, which is incorporated herein by reference in its entirety.

BACKGROUND

Janitorial closets are found in public and private buildings and are used to store cleaning tools such as mops, brushes brooms and the like, cleaning supplies, carts, mop buckets and other equipment. The typical janitorial closet also includes a sink that may be mounted at floor level to facilitate the filling of mop buckets and the cleaning of mops brooms and other tools. The sink may also be mounted at a standard height above the floor. The mops, brushes, brooms and other tools are typically left in the sink after use to drain and dry off making access to the sink difficult and creating disorganization and a hazard due to falling tools.

SUMMARY OF THE INVENTION

A sink extender comprises a sink comprising a drain connected to a conduit. An attachment mechanism connects the sink to a support. At least one tool holder supports an elongated handle of a janitorial tool over the sink.

The sink may comprise a base having an opening that extends through the base. The sink may comprise a removable drain pain having a drain opening. The sink may comprise a base having an opening that extends through the base where the drain pan is located below the opening. The sink may comprise a base having an opening that extends through the base where the base defines rails for receiving the drain pan. The drain pan may comprise ledges that ride on the rails such that the drain pain is slidably received in the base. The base may support a drain platform. The drain platform may comprise a grate. The drain opening may connect to a hose where the hose comprises a flexible conduit that is dimensioned to allow fluid to freely drain from the pan. The hose may have a length such that the hose can reach between the sink and a traditional sink. A frame may extend from the sink where the attachment mechanism is on the frame. The frame may comprise at least one tool holder. The at least one tool holder may be disposed relative to the sink such that a tool held by the tool holder is disposed over the sink. The at least one tool holder may comprise a deformable gripper. The attachment mechanism may comprise at least one flange provided with an aperture. The attachment mechanism may comprise a hook, a clamp or a gripper that is configured to engage a horizontal rail.

A sink extender comprises a sink comprising a base supporting a removable drain pan having a drain. A mechanism selectively closes the drain. An attachment mechanism connects the sink to a support. At least one tool holder is provided for supporting an elongated handle over the sink.

A method of using a sink extender comprises mounting the sink extender comprising a sink that drains into a flexible hose and at least one tool holder to a support surface; running the hose to a traditional sink such that water may drain from the sink to the traditional sink by gravity; securing a wet tool to the at least one tool holder such that the tool drains into the sink. The sink may further comprise a drain platform over the sink and the step of securing may comprise resting the tool on the drain platform.

DETAILED DESCRIPTION OF EMBODIMENT OF THE INVENTION

Figure 1:
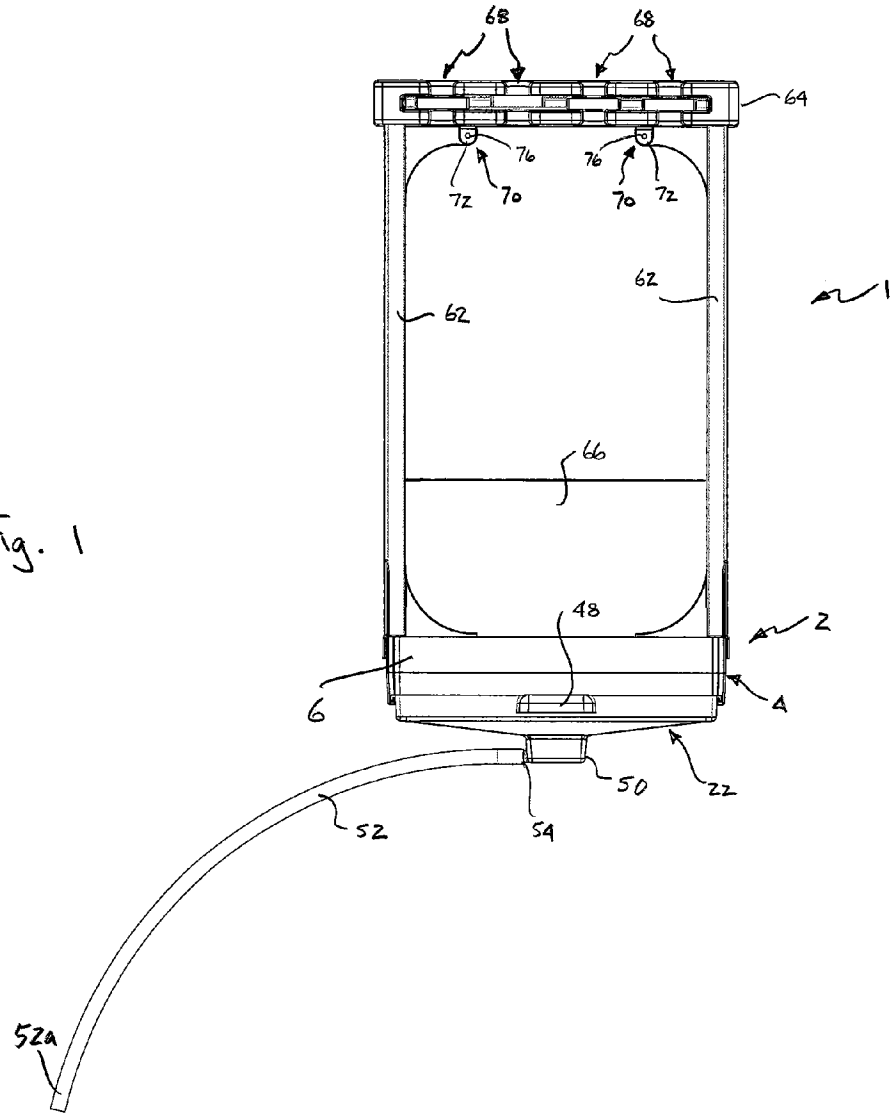
FIG. 1 is a front view of an embodiment of the sink extender of the invention.
Figure 3:
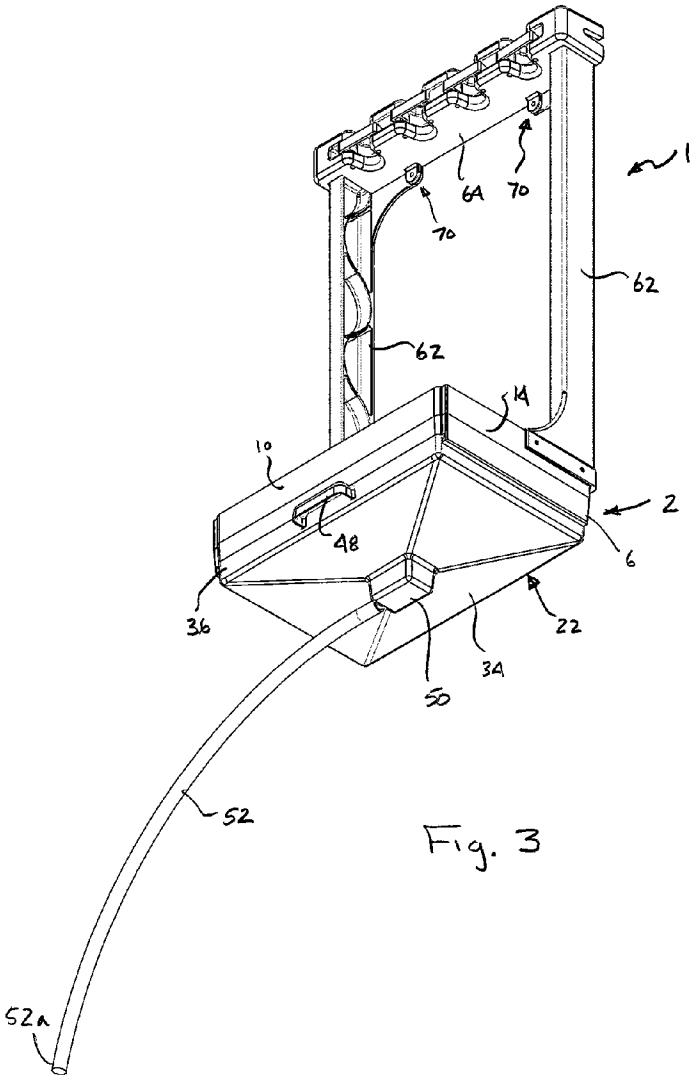
FIG. 3 is a bottom perspective view of the sink extender of FIG. 1.
Figure 2:
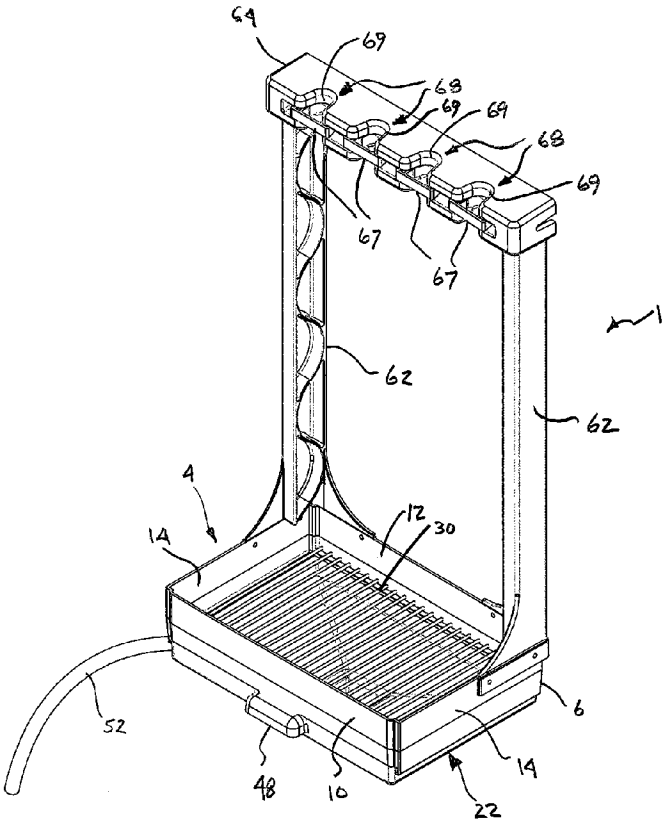
FIG. 2 is a top perspective view of the sink extender of FIG. 1.
Figure 4:
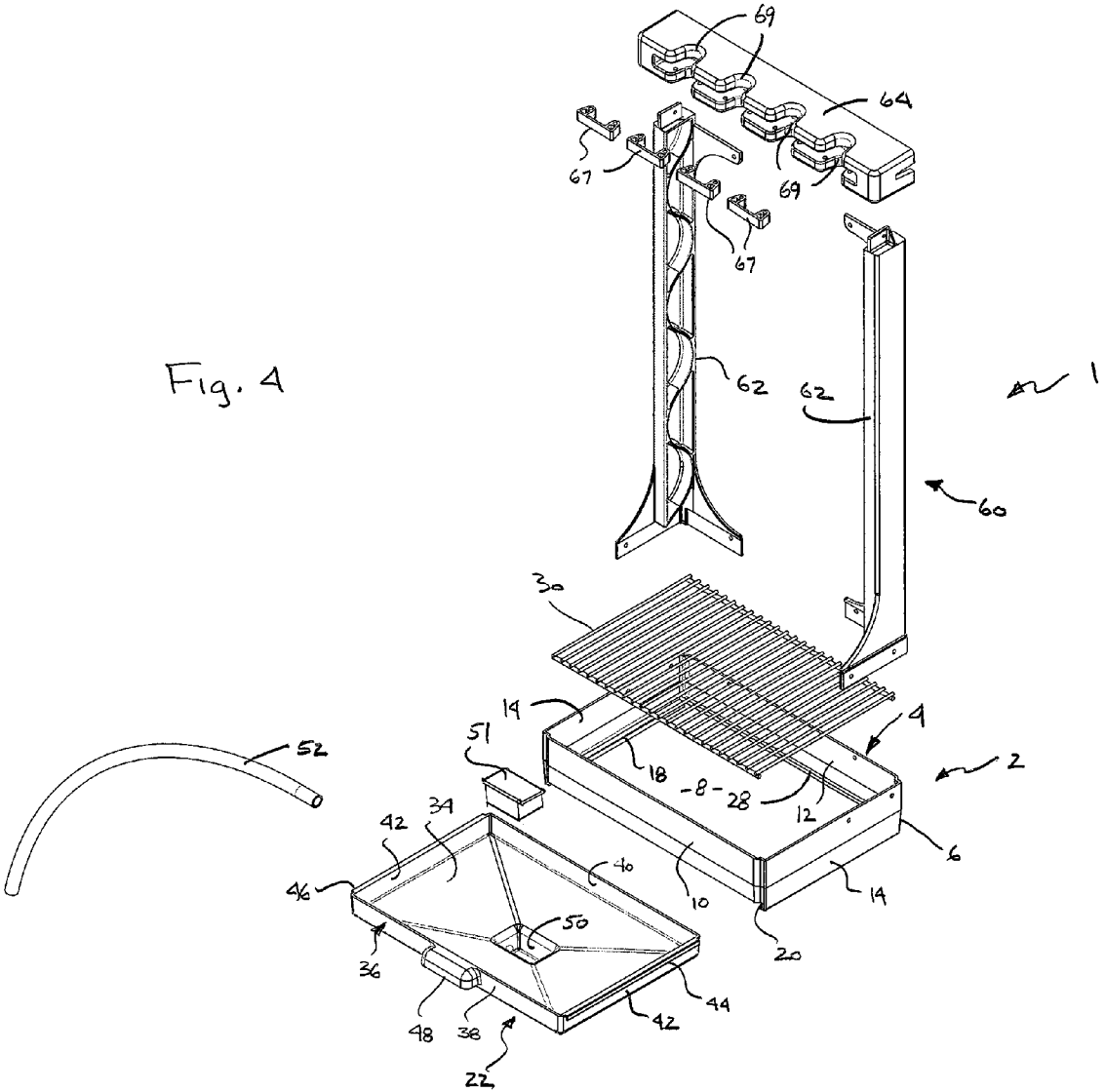
FIG. 4 is an exploded perspective view of the sink extender of FIG. 1.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. It will be understood that, although the terms first, second, etc. ay be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Relative terms such as "below" or "above" or "upper" or "lower" or "front" or "back" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, steps, operations, elements, and/or components, but do not preclude the presence or addition of one or more other features, steps, operations, elements, components, and/or groups thereof.

An embodiment of the sink extender 1 of the invention is shown comprising a drain sink 2 defined by a base 4 having a peripheral wall 6 that defines an opening 8 that extends through the base 4. The wall 6 has a front wall 10, a back wall 12 and a pair of side walls 14 connecting the front wall 10 and the back wall 12. While in the illustrated embodiment the base 4 is formed as a rectangular structure, the base may have any suitable shape. The side walls 12 extend below the front wall 10 and include inwardly extending flanges 18 and 20 that create rails or ledges for receiving a drain pan 22. The base 4 may be made of injection molded plastic.

An inwardly facing flange 28 is formed on the inside surface of the wall 6. Flange 28 supports a horizontal drain platform 30 that rests on top of the flange 28 to create a work surface that may support articles in the sink and allows liquids to drain through the platform 30. In the illustrated embodiment a flange 28 is formed on the back wall 12 and the front wall 10 although the flange 28 may be formed along the entire wall 6. In the illustrated embodiment the platform 30 is formed as a grate comprised of crossed wires. The platform 30 may also be formed as a solid surface formed with drain holes or a similar structure.

Drain pan 32 comprises a bottom wall 34 and an upstanding peripheral wall 36 shaped and sized such that the pan 32 is substantially co-extensive with the base 4. The peripheral wall 36 comprises a front wall 38, a back wall 40 and a pair of side walls 42. The side walls 42 include outwardly extending flanges 44 and 46 that create rails or ledges that rest on top of flanges 24 and 26 to support the pan 32 on the base 4. The pan 32 is removably mounted on the base 4 by sliding the rails 44 and 46 of drain pan on the rails 24 and of the base 4. A handle 48 may be provided on the front wall 38 that may be grasped by a user to remove the drain pan 32 from base 4. The bottom wall 34 is formed with a drain opening 50 that connects to a hose 52 at fitting 54. The bottom wall 34 is sloped toward drain opening 50 such that fluid in the drain pan 32 will flow to the drain opening 50 by gravity. The hose 52 is a flexible conduit that is dimensioned to allow fluid to freely drain from the pan 32. The length of the hose 52 is selected such that the hose can reach between the sink extender 1 and a sink.

Figure 5:
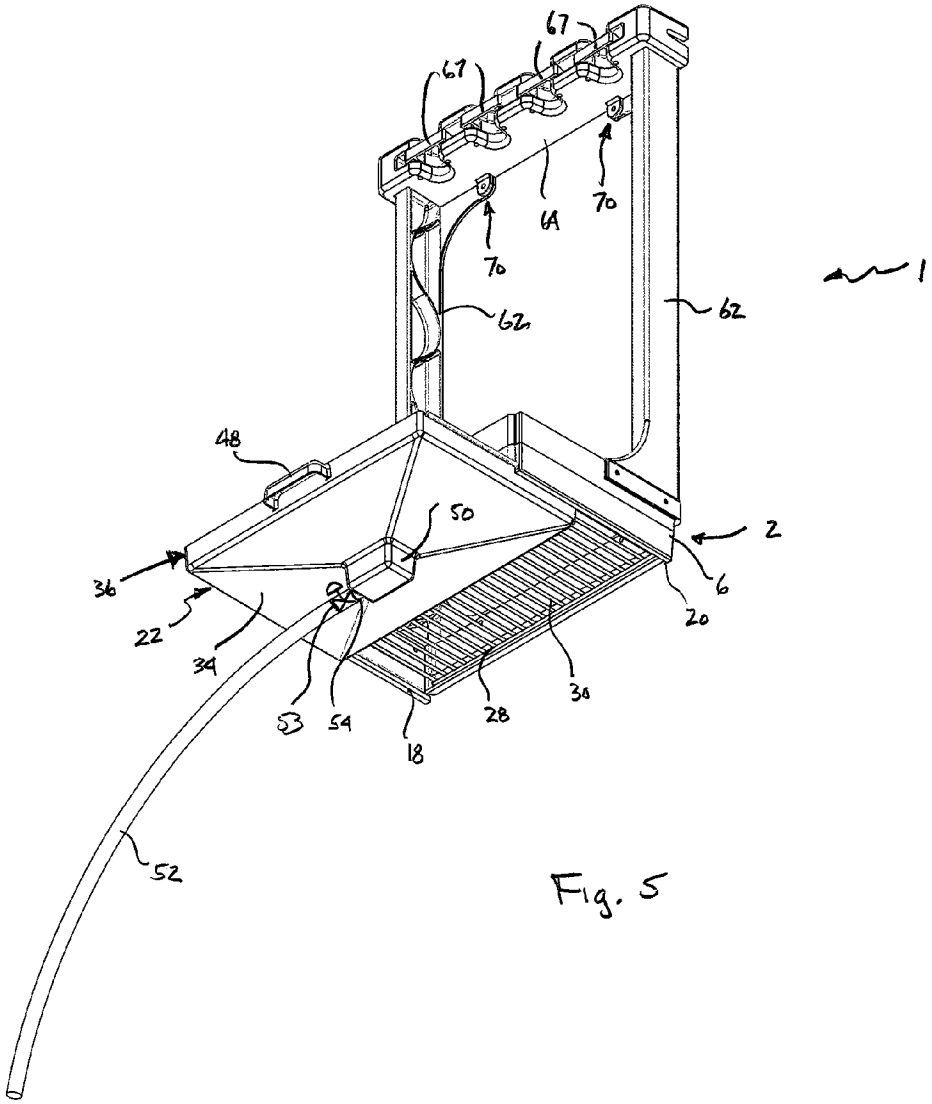
FIG. 5 is a bottom perspective view of an alternate embodiment of the sink extender showing the drain pan partially removed.

The hose 52 may be removed from fitting 54 and the drain opening 50 may be selectively closed using a closing mechanism such that the drain pan 32 fills with the fluid. The closing mechanism may comprise a plug 51 that fits into opening 50 to create a liquid tight seal. The closing mechanism may comprise a valve 53 (FIG. 5) that closes the opening 50 from drain pan 32 to prevent the drainage of fluid from the drain pan. The drain pan 32 may be removed from the base 4 such that the drain pan 32 may be carried to a sink or elsewhere and the collected fluid dumped from the drain pan. The drain pan 32 may also be permanently attached to the base and a separate basin may be releasably secured to the drain pan such that fluid drains from the drain pan through the drain opening 50 and into the basin. The basin may be releasably secured to the drain pan using a screw thread connector or the like such that the basin may be removed and the contents dumped.

A frame 60 extends upward from the base 6 along the back thereof. In the illustrated embodiment the frame 60 comprises a pair of spaced uprights 62 that are connected by a cross member 64 at their upper ends. A splash guard 66 may be provided between the uprights 62 at the back of the base to prevent liquids from spilling out the back of the sink. While the frame 60 is shown as a pair of spaced uprights the frame may comprise a solid member.

The cross member 64 comprises a plurality of tool holders 68 such that the handles of tools such as mops, squeegees, brushes, brooms or the like may be retained vertically with the tool head supported above the sink 2. The tool holders 68 may comprise recesses 69 formed in member 64 dimension to receive the elongated handle of a janitorial tool. Deformable grippers 67 such as rubber extrusions are located in the recesses 69 such that the deformable grippers 67 deform when a handle is located in one of the recesses 69 to create a squeezing force on the handle that securely holds the tool on the frame 60. The bottom of the tools may be supported on the platform 30 such that tool holders do not have to support the weight of the tool and only need to maintain the tools vertically. The tools are securely supported such that the wet tools may drain into the sink 2.

Figure 7:
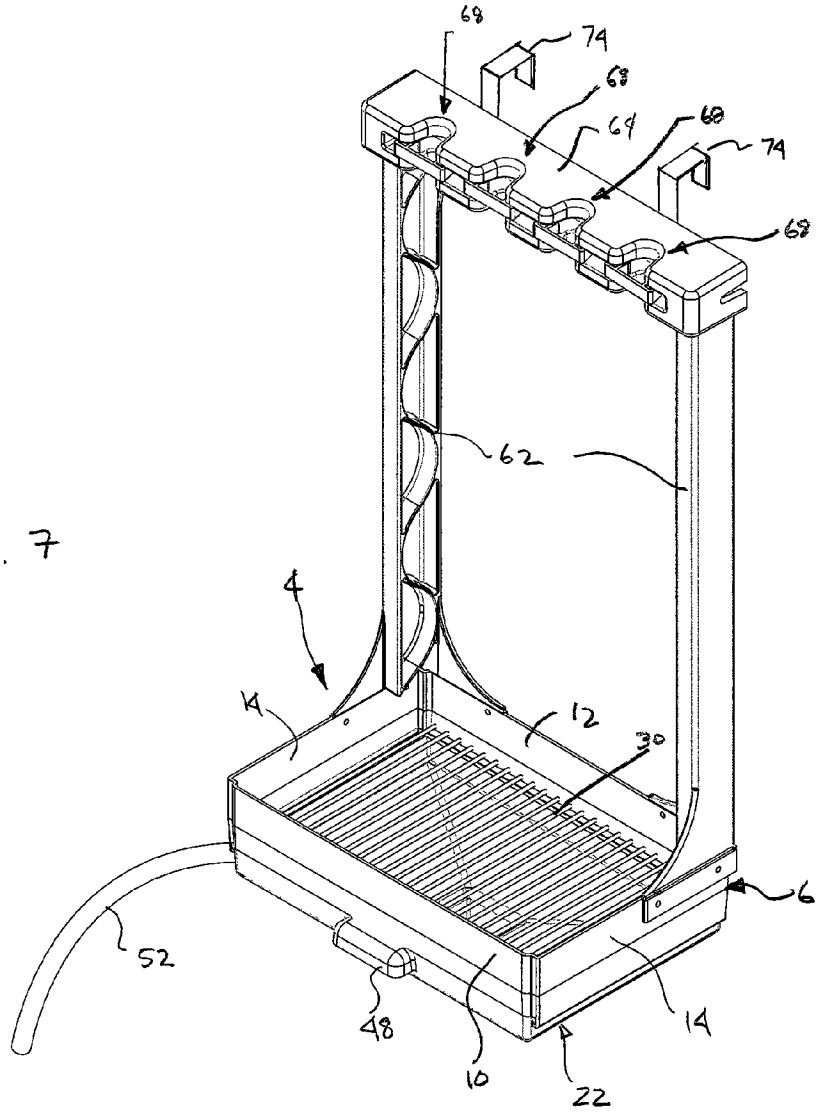
FIG. 7 is a top perspective view of an alternate embodiment of the sink extender.
Figure 8:
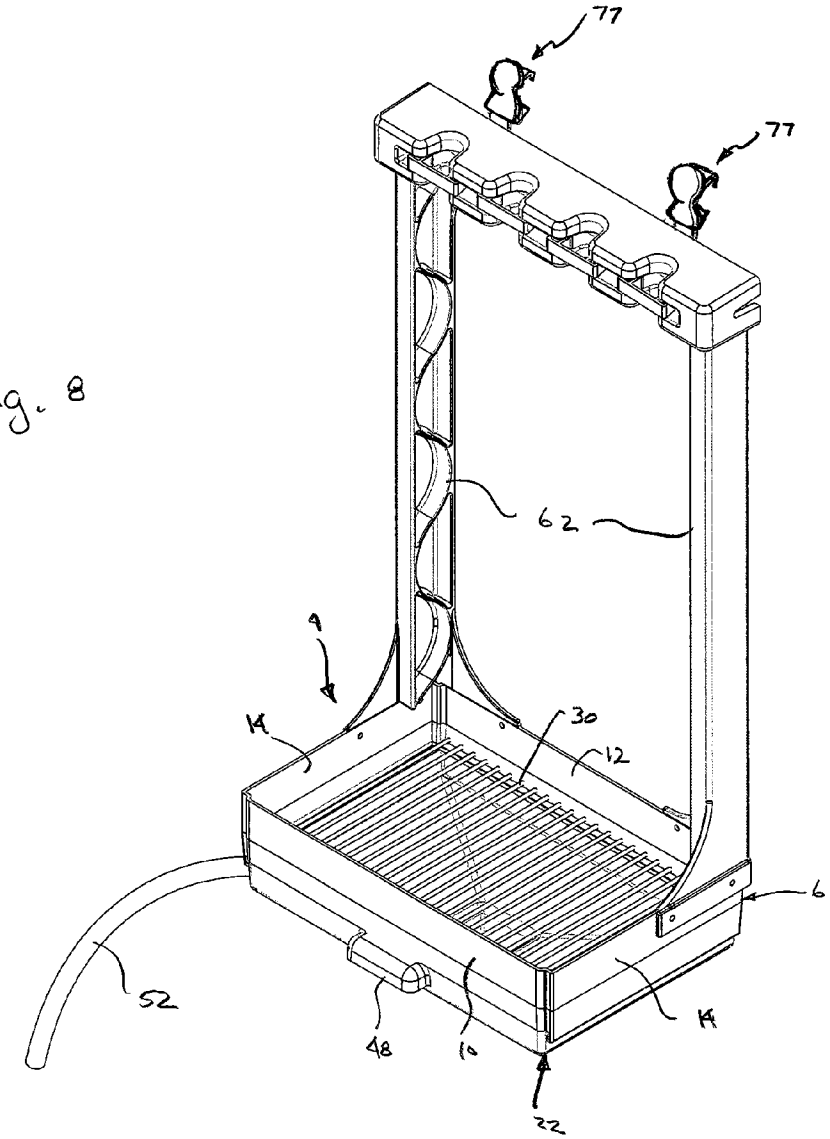
FIG. 8 is a top perspective view of another alternate embodiment of the sink extender.

The sink extender may be attached to a wall or other structure using an attachment mechanism 70. In the illustrated embodiment the attachment mechanism 70 comprises mounting flanges 72 that are arranged so as to be substantially flush to a wall or other support surface. Flanges 72 are provided with apertures 76 that receive fasteners such as screws that secure the sink extender 1 to the support surface. In the illustrated embodiment the mounting flanges 72 are disposed along the cross member 64 and may be provided along the sides of the frame 60 or base 4. Referring to FIG. 7, the flanges 72 may be replaced by hooks or clamps 74 that suspend the sink extender 1 from a support such as a shelving unit or the like. Further, referring to FIG. 8, the attachment mechanism may comprise grippers 77 that engage a horizontal or vertical rail such as found in the FAST TRACK® storage system sold by Newell Rubbermaid, Inc. One such gripper is disclosed in U.S. patent application Ser. No. 12/906,686 filed on Oct. 18, 2010, titled Rail Storage System the disclosure of which is incorporated herein in its entirety. Preferably the attachment mechanism allows the sink extender to be easily and quickly mounted to a surface by an end user separate from the sink installation.

Figure 6:
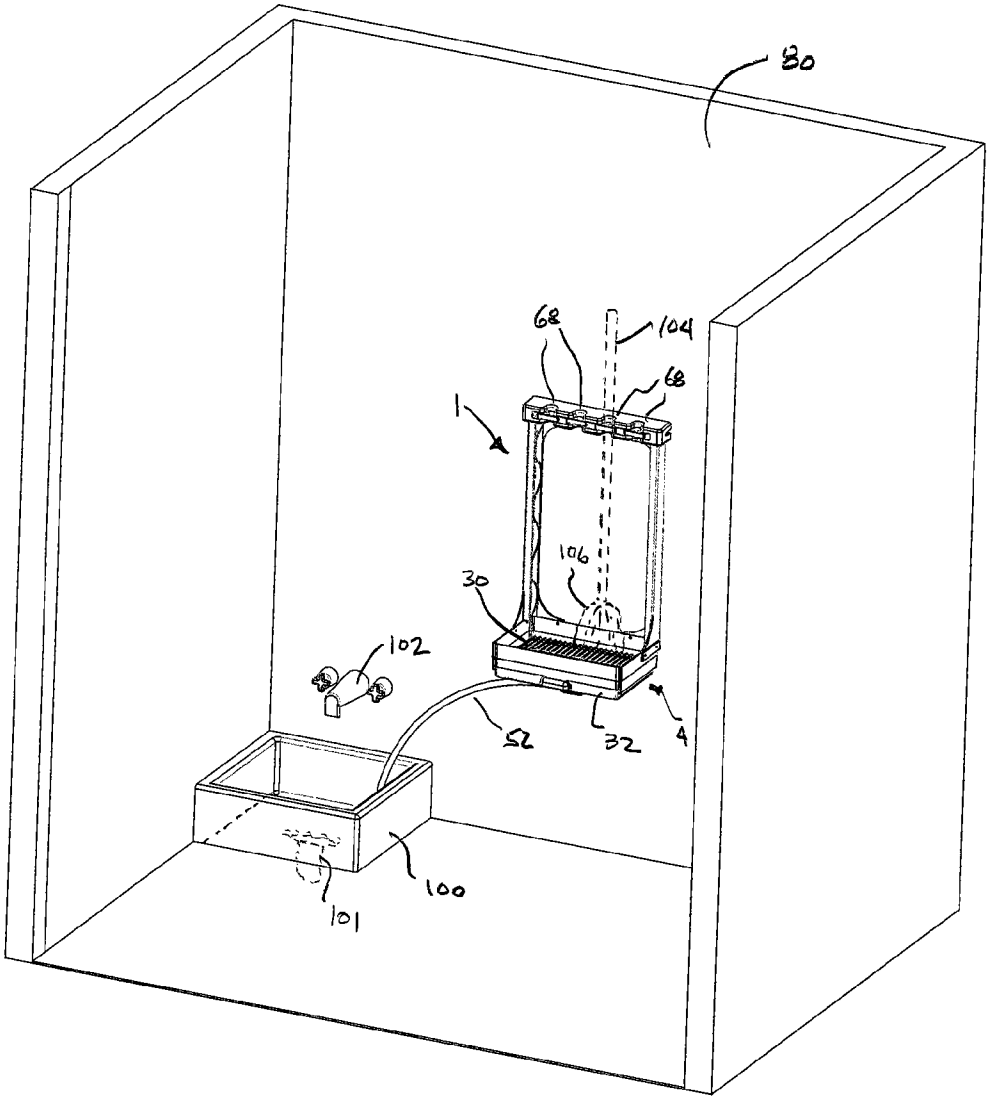
FIG. 6 is a perspective view illustrating an embodiment of a method of using the sink extender.

Referring to FIG. 6, in operation the sink extender 1 is mounted to a support surface 80 such as a wall using the attachment mechanism 70. The sink extender 1 may be mounted relative to a traditional sink 100 such that the hose 52 may span the distance between the sink extender 1 and the traditional sink 100. As used herein the term "traditional sink" refers to a plumbing fixture that is connected to a building's plumbing system using a drain and permanent plumbing 101 and may comprise a janitor's sink or a standard sink. The sink 100 may also be a source of water via a faucet 102 connected to a building's water supply. Conversely, the sink extender 1 does not comprise an independent source of water and may be mounted at a location remote from the building's plumbing 101 provided that hose 52 may reach a drain. Typically, the sink extender 1 will be mounted relatively closely to the traditional sink 100. The sink extender 1 is also mounted above the drain 101 of the traditional sink such that fluid in the sink extender 1 may flow through hose 52 by gravity to the drain 101 of the traditional sink 100. The free end 52*a* of the hose is located in the traditional sink 100 such that fluid from the sink extender 1 may drain into the traditional sink. Other than running the hose 52 to the traditional sink 100 no other plumbing is required to install the sink extender 1 and no permanent plumbing is required. Tools 104 such as mops, brushes, squeegees, brooms and the like may be stored in the sink extender by securing the tool handle into one of the tool holders 68. The tools 104 are arranged such that the tool head 106 is disposed over the sink 4 and the tool head may rest on platform 30. Wet tools 104 may be stored on the sink extender 1 such that they drain into drain pan 30. The fluid collected by the drain pan 30 may be transported to the traditional sink 100 by hose 52 or the drain pan 32 may be closed using plug 51 or valve 53 and may be removed and the fluid dumped from the drain pan 32. The sink extender 1 provides a convenient storage and drainage system for janitorial tools and the like.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A sink extender comprising:

a sink comprising a drain opening connected to a conduit, the conduit terminating in a free end that is not connected to permanent plumbing, where the sink extender is not connected to plumbing such that the sink extender does not have a source of water;

an attachment mechanism for connecting the sink to a support such that the sink is stationary;

at least one tool holder for supporting an elongated handle over the sink.

2. The sink extender of claim 1 wherein the sink comprises a base and a removable drain pan.

3. The sink extender of claim 1 wherein the sink comprises a removable drain pan comprising the drain opening.

4. The sink extender of claim 3 wherein the sink comprises a base having an opening that extends through the base, the drain pan being mounted in and located below the opening.

5. The sink extender of claim 3 wherein the sink comprises a base having an opening that extends through the base, the base defining rails for receiving the drain pan.

6. The sink extender of claim 5 wherein the drain pan comprises ledges that ride on the rails such that the drain pain is slidably received in the base.

7. The sink extender of claim 2 wherein the base supports a drain platform and a drain pan located below the drain platform, the drain pan comprising the drain opening.

8. The sink extender of claim 7 wherein the drain platform comprises a grate.

9. The sink extender of claim 1 wherein the conduit comprises a flexible conduit.

10. The sink extender of claim 9 wherein the flexible conduit is configured to allow fluid to freely drain from the pan.

11. The sink extender of claim 10 wherein the flexible conduit has a length such that the flexible conduit can reach between the sink and a traditional sink.

12. The sink extender of claim 1 further comprising a frame extending from the sink, the attachment mechanism being on the frame.

13. The sink extender of claim 12 wherein the frame supports the at least one tool holder.

14. The sink extender of claim 13 wherein the at least one tool holder is disposed relative to the sink such that a tool held by the tool holder is disposed over the sink.

15. The sink extender of claim 13 wherein the at least one tool holder comprises a deformable gripper.

16. The sink extender of claim 1 wherein the attachment mechanism comprises at least one flange provided with an aperture.

17. The sink extender of claim 1 wherein the attachment mechanism comprises a hook.

18. The sink extender of claim 1 wherein the attachment mechanism comprises a gripper that is configured to engage a rail.

19. A method of using a sink extender comprises:

mounting the sink extender comprising a sink that drains into a flexible hose and at least one tool holder to a support surface;

running the hose to a traditional sink such that water may drain from the sink to the traditional sink by gravity;

securing a wet tool to the at least one tool holder such that the tool drains into the sink.

20. The method of claim 19 wherein the sink further comprises a drain platform over the sink and the step of securing comprises resting the tool on the drain platform.

21. A sink extender comprising:

a sink comprising a drain connected to a conduit, the sink comprising a removable drain pain having a drain opening and a base having an opening that extends through the base, the base defining rails for receiving the drain pan and the drain pan comprising ledges that ride on the rails such that the drain pain is slidably received in the base;

an attachment mechanism for connecting the sink to a support;

at least one tool holder for supporting an elongated handle over the sink.

* * * * *